US011858541B2

(12) United States Patent
Herzog et al.

(10) Patent No.: US 11,858,541 B2
(45) Date of Patent: Jan. 2, 2024

(54) ARTICULATED RAIL-TRANSPORT CAR

(71) Applicant: Herzog Railroad Services, Inc., St. Joseph, MO (US)

(72) Inventors: Jacob D. Herzog, St. Joseph, MO (US); Matt Combs, Agency, MO (US); Tony Shirk, Clarksdale, MO (US)

(73) Assignee: Herzog Railroad Services, Inc., St. Joseph, MO (US)

( * ) Notice: Subject to any disclaimer, the term of this patent is extended or adjusted under 35 U.S.C. 154(b) by 972 days.

(21) Appl. No.: 16/811,395

(22) Filed: Mar. 6, 2020

(65) Prior Publication Data

US 2020/0298893 A1 Sep. 24, 2020

Related U.S. Application Data

(60) Provisional application No. 62/821,418, filed on Mar. 20, 2019.

(51) Int. Cl.

| | |
|---|---|
| ***B61D 3/10*** | (2006.01) |
| ***B61D 3/16*** | (2006.01) |
| ***B61F 3/12*** | (2006.01) |

(52) U.S. Cl.

CPC ..... *B61D 3/10* (2013.01); *B61D 3/16* (2013.01); *B61F 3/12* (2013.01)

(58) Field of Classification Search

CPC .. E01B 29/17; B61D 3/10; B61D 3/16; B61F 3/12

See application file for complete search history.

(56) References Cited

U.S. PATENT DOCUMENTS

| | | | | |
|---|---|---|---|---|
| 1,704,269 | A | 3/1929 | Wattmann | |
| 3,288,082 | A * | 11/1966 | Brosnan | E01B 29/17 104/2 |
| 4,478,155 | A | 10/1984 | Cena et al. | |
| 4,947,760 | A | 8/1990 | Dawson et al. | |
| 5,129,327 | A | 7/1992 | Snead | |
| 7,047,889 | B2 * | 5/2006 | Forbes | B61G 5/02 410/24 |

(Continued)

FOREIGN PATENT DOCUMENTS

| | | | |
|---|---|---|---|
| DE | 3522918 | A1 | 9/1986 |
| GB | 2159558 | A | 12/1985 |
| SU | 1614979 | A1 | 12/1990 |

*Primary Examiner* — Scott A Browne
(74) *Attorney, Agent, or Firm* — AVEK IP, LLC; Kent R. Erickson

(57) ABSTRACT

An articulated rail-transport car for transporting long sections of ribbon rail is described. The car includes a plurality of segments arranged end-to-end and coupled and supported at their adjacent ends by shared trucks. Dedicated trucks are provided near each terminal end of the car and couplers configured to couple to an adjacent rail car are provided at the respective terminal ends. Rail stands are disposed along the length of the car with a spacing that is independent of the locations of the shared and dedicated trucks and that provides a greater number of rail stands than trucks. The segments may be configured to enable interchangeability and to allow any number of the segments to be included in the car. A plurality of the cars can be coupled to enable transport of ribbon rails of any length.

24 Claims, 5 Drawing Sheets

(56) References Cited

U.S. PATENT DOCUMENTS

| | | | | |
|---|---|---|---|---|
| 7,255,047 | B1 * | 8/2007 | Coslovi | B61D 3/187 105/355 |
| 7,350,467 | B2 * | 4/2008 | Green | E01B 29/05 104/7.1 |
| 8,181,577 | B2 | 5/2012 | Bounds | |
| 11,492,024 | B2 * | 11/2022 | Bowker | B61D 3/08 |
| 2004/0261650 | A1 * | 12/2004 | Al-Kaabi | B61D 3/10 105/30 |
| 2011/0041721 | A1 * | 2/2011 | Bounds | E01B 29/17 104/2 |
| 2011/0129314 | A1 * | 6/2011 | Bounds | E01B 29/16 410/44 |
| 2012/0145032 | A1 * | 6/2012 | Bounds | E01B 29/17 105/4.1 |
| 2012/0199038 | A1 * | 8/2012 | Herzog | E01B 29/17 211/183 |
| 2014/0251174 | A1 * | 9/2014 | Herzog | E01B 29/17 104/5 |
| 2014/0255119 | A1 * | 9/2014 | Herzog | B61D 45/003 410/44 |
| 2020/0145032 | A1 | 5/2020 | Ayala et al. | |

* cited by examiner

ARTICULATED RAIL-TRANSPORT CAR

CROSS-REFERENCE TO RELATED APPLICATIONS

This application claims the benefit of U.S. Provisional Patent Application No. 62/821,418 filed Mar. 20, 2019 the disclosure of which is hereby incorporated herein in its entirety by reference.

BACKGROUND

Modern railroad tracks are constructed using long sections of rail commonly referred to as ribbon rail. The sections are often found in lengths up to about 1,600 feet but can range up to 2,000 feet or longer. Shorter sections of lengths as little as 300-320 feet are also available. These sections of ribbon rail are formed by butt-welding multiple shorter sections of rail, which traditionally come from a steel mill in thirty-nine foot or seventy-eight-foot lengths. The welding of the ribbon rails is done at a welding plant and the welded ribbon rails are transported to their installation site on a specially constructed rail-transport train.

Prior art rail-transport trains traditionally comprise a plurality of sixty-foot-long flatcars connected together by standard railroad couplers. Each car includes a pair of transverse stands for supporting the ribbon rail. The stands of each car are spaced 30 feet apart and 15 feet from the respective coupler such that the stands are spaced 30 feet apart along the length of the rail train. The stands each include multiple tiers (typically five or six tiers) that each support a plurality of rails, for example, eight to twelve rails per tier. The stands must each be strong enough both to support the weight of the rails and to resist side loads created by flexing of the ribbon rails as the rail train traverses curves in the track. U.S. Pat. No. 3,288,082 to Brosnan; U.S. Pat. No. 7,350,467 to Green et al.; and U.S. Pat. No. 8,181,577 to Bounds depict examples of such available configurations.

Other available rail-transport trains may employ one or more cars having an articulated car configuration in which a plurality of segments are joined at pivotal couplings supported by shared trucks or bogies. The segments may be flatcars or may utilize other configurations such as spine-car or skeleton car configurations. For example, the Gen II Rail Train from Herzog Railroad Services, Inc. of St. Joseph, Missouri utilizes an articulated car configuration that includes a plurality of identical segments having a spine-car configuration and that are joined together on shared trucks. U.S. Pat. No. 4,947,760 to Dawson et al. and U.S. Patent Application Publication No. 2004/0261650 to Al-Kaabi et al. depict examples of articulated rail cars having a plurality of segments with shared trucks therebetween.

At least one car in each rail-transport train is a tie-down car that includes a specialized stand with means for fixing the rails to the racks to prevent longitudinal movement of the rails relative to the tie-down car, like for example that describe in U.S. Pat. No. 8,181,577 to Bounds. The fixing means generally includes a plurality of clamping blocks that are bolted to the stand on opposite sides of each rail so as to bear against the foot or base flange of the rail and clamp it against the stand. Typically, each clamping block is held down by large bolts which must be installed or removed using an impact wrench or the like. All the other racks in the train allow for relative longitudinal movement of the rails and may include rollers that support the rails. This relative movement between the racks and the rails is required in order to allow the rails to flex without stretching or compressing as the train traverses curves in the track, as well as to allow for coupler slack that exists in each of the couplers between cars.

Each coupler has up to approximately six inches of slack. Coupler slack necessitates that the tie-down car be positioned near the center of the rail train so as to evenly divide the rails and to thereby insure that neither the forward end nor the rearward end of the rail can move a distance relative to the nearest adjacent rack that the end will come off of the rack.

SUMMARY

Exemplary embodiments are defined by the claims below, not this summary. A high-level overview of various aspects thereof is provided here to introduce a selection of concepts that are further described in the Detailed-Description section below. This summary is not intended to identify key features or essential features of the claimed subject matter, nor is it intended to be used in isolation to determine the scope of the claimed subject matter. In brief, this disclosure describes an articulated rail-transport car for transporting sections of ribbon rail along a railway.

The articulated rail-transport car includes a plurality of segments pivotably coupled end-to-end on shared trucks with segments at ends of the car also being supported on respective dedicated trucks. Couplers are provided at each end of the car for coupling to additional, similarly configured rail-transport cars or other rail-based cars/vehicles. The segments of the car may include a leading-end segment and a trailing-end segment, a central segment, and one or more intermediate or interchangeable segments. Adjacent ends of each of the segments include corresponding male or female configurations that can be mated and supported on the respective shared trucks. In one embodiment, the central section includes matching male or female end configurations, the intermediate segments include one end with a male configuration and the other end with a female configuration, and the leading-end and the trailing-end segments include one end configured oppositely from that of the central section. As such, the leading-end and trailing-end segments can be joined directly to the central segment or any number of intermediate segments may be disposed therebetween.

A plurality of rail stands for carrying a plurality of sections of ribbon rail are disposed along the length of the car. The stands are disposed spaced apart along the longitudinal length of the car at distances configured to enable loading of ribbon rails thereon without excessive droop in a leading end of the ribbon rail that would hinder loading. The spacing is also configured to provide sufficient flexibility in the loaded ribbon rails to allow the car to travel along curves in the railway. The spacing and locations of the stands is independent of a spacing between the shared trucks and is asymmetrical relative, at least to the intermediate, leading-end, and trailing-end segments. Further, a number of stands disposed on the car is greater than the total number of trucks, i.e. the sum of the number of shared trucks and the number of dedicated trucks. In one embodiment, the ratio of the number of stands to the number of trucks (shared and dedicated) is greater than 1:1 or greater than 3:2.

In one embodiment, an articulated rail-transport car for transporting a plurality of ribbon rails along a railway is described. The car includes a plurality of longitudinally extending segments disposed end-to-end with a plurality of shared trucks disposed beneath junctions of adjacent ones of the segments to support adjacent respective ends of the segments and to enable pivoting of the segments relative to one another. The car also includes a dedicated truck supporting a free end of each of the segments disposed at opposite ends of the car and a number of rail stands configured to support a plurality of ribbon rails disposed thereon. The rail stands are spaced apart along a longitudinal length of the car and are spaced longitudinally apart from each of the shared trucks. A ratio of the number of rail stands to a total number of the shared trucks and the dedicated trucks is greater than one rail stand to one truck or greater than three rail stands to two trucks.

In another embodiment, a rail-transport consist for transporting a plurality of ribbon rails along a railway is described. The consist includes a plurality of articulated rail-transport cars coupled end-to-end. Each car includes a plurality of longitudinally extending segments pivotably coupled end-to-end via shared trucks. Ends of the car are supported by respective dedicated trucks and include respective car couplers configured to couple to an adjacent car. The cars further include a plurality of rail stands disposed spaced longitudinally apart along the plurality of segments and configured to support a ribbon rail disposed thereon. On each car a ratio of a number of rail stands to a total number of shared and dedicated trucks is greater than one rail stand to one truck or greater than three rail stands to two trucks. The consist also includes a tie-down car disposed centrally within the rail-transport train between adjacent ones of the rail-transport cars and configured to secure the ribbon rail against longitudinal movement along the rail-transport train.

In another embodiment, an articulated rail-transport car for transporting a plurality of ribbon rails along a railway is described. The car includes a first end-segment that includes a first dedicated truck supporting a first end of the first end-segment. The first end of the first end-segment includes a first coupler configured to couple to an adjacent rail car. An opposite second end of the first end-segment includes a first type of shared-truck-coupling. The car further includes a second end-segment that includes a second dedicated truck supporting a first end of the second end-segment. The first end of the second end-segment includes a second coupler configured to couple to an adjacent rail car and an opposite second end of the second end-segment including the first type of shared-truck coupling. A central segment is provided that includes a second type of shared-truck coupling at each end thereof. The car also includes one or more intermediate segments that include the first type of shared-truck coupling at one end and the second type of shared-truck coupling at the opposite end. A plurality of shared trucks are disposed beneath junctions between adjacent ones of the first end-segment, the second end-segment, the central segment, and the one or more intermediate segments. The shared trucks support adjacent respective ends of the segments and enable pivoting of the segments relative to one another. A number of rail stands configured to support a plurality of ribbon rails are disposed on the segments. The rail stands are spaced apart along a longitudinal length of the car and spaced longitudinally apart from each of the shared trucks. A ratio of the number of rail stands to a total number of the shared trucks and the dedicated trucks is greater than one rail stand to one truck or greater than three rail stands to two trucks.

DESCRIPTION OF THE DRAWINGS

Illustrative embodiments are described in detail below with reference to the attached drawing figures, and wherein.

DETAILED DESCRIPTION

Figure 1:
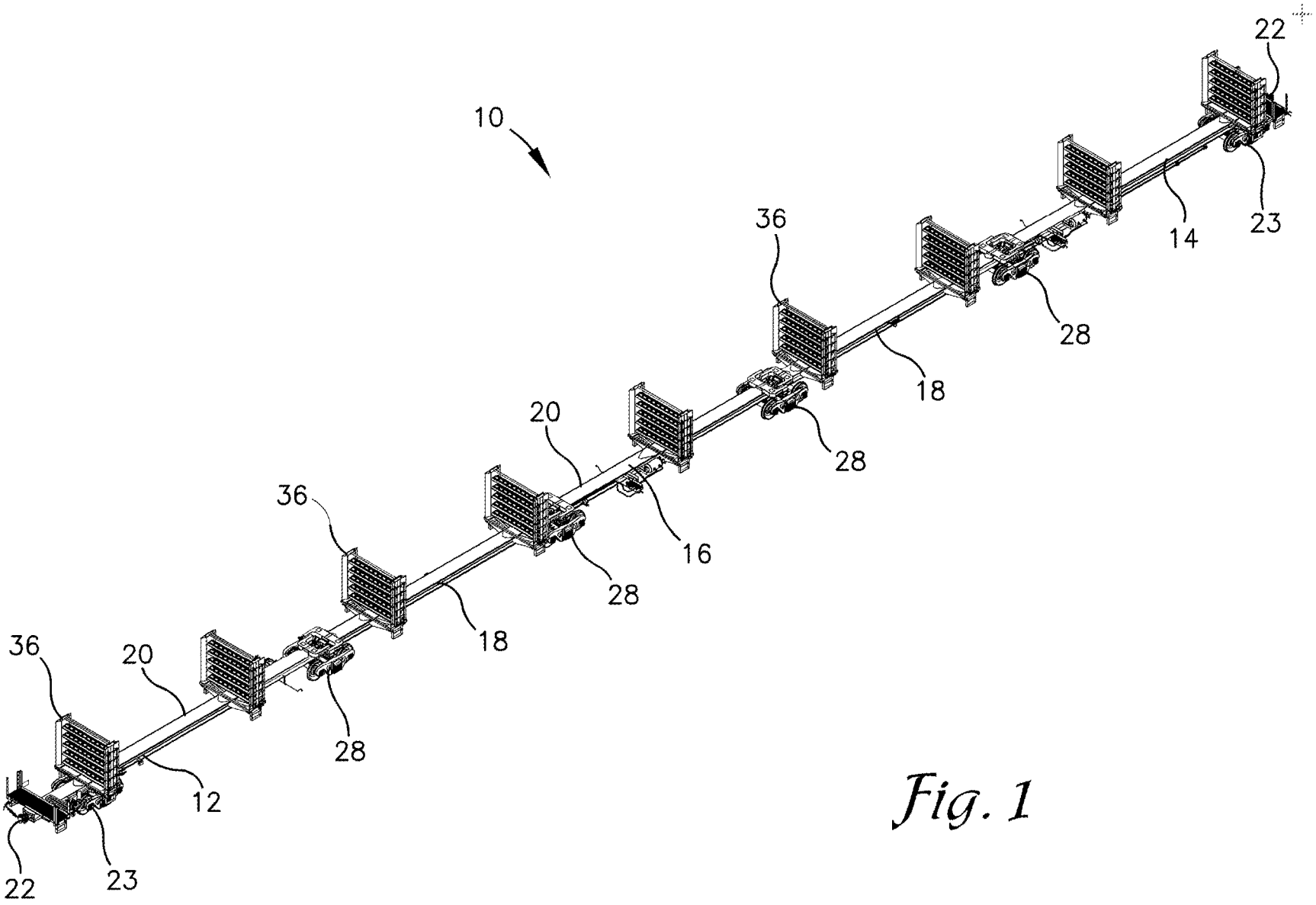
FIG. 1 is a perspective view of an articulated rail-transport car depicted in accordance with an exemplary embodiment.

The subject matter of select exemplary embodiments is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described. The terms "about" or "approximately" or "substantially" as used herein denote deviations from the exact value by +/− 10%, preferably by +/− 5% and/or deviations in the form of changes that are insignificant to the function.

With reference now to FIGS. 1-4, an articulated rail-transport car 10 is described in accordance with an exemplary embodiment. The car 10 may be coupled to one or more similarly configured cars 10 among a variety of other rail cars and may be moved or propelled along a railway by an independent or separate propulsion unit. The car 10 is comprised of a plurality of segments that are pivotably coupled end-to-end. The segments may include a leading-end segment 12, a trailing-end segment 14, a central segment 16, and a plurality of interchangeable or intermediate segments 18. The leading-end and trailing-end segments 12, 14 are referred to as such for sake of convenience and not to denote any requirement on their orientation or a direction of travel of the car 10.

Figure 2:
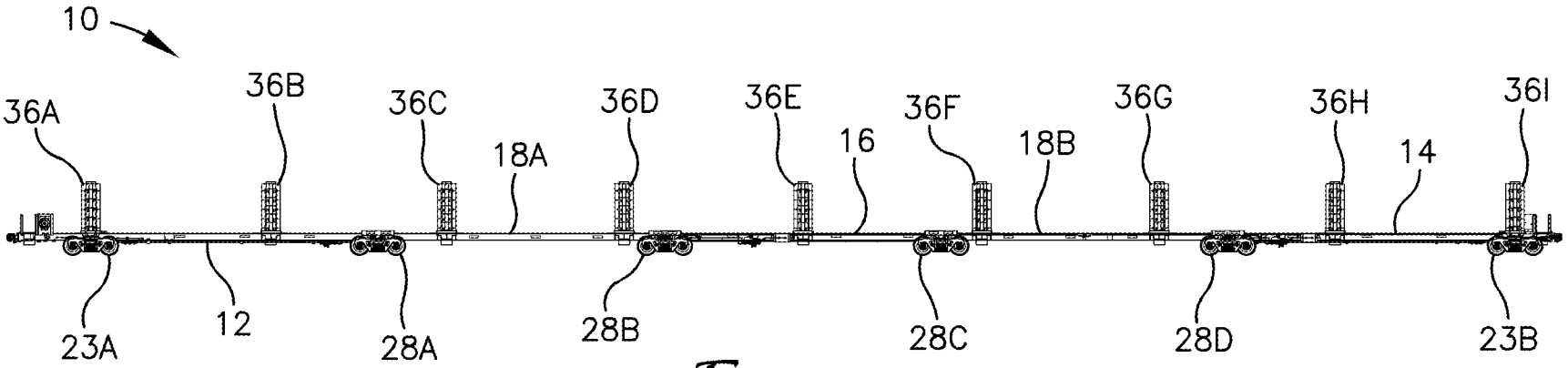
FIG. 2 is a side elevational view of the car of FIG. 1.
Figure 3:
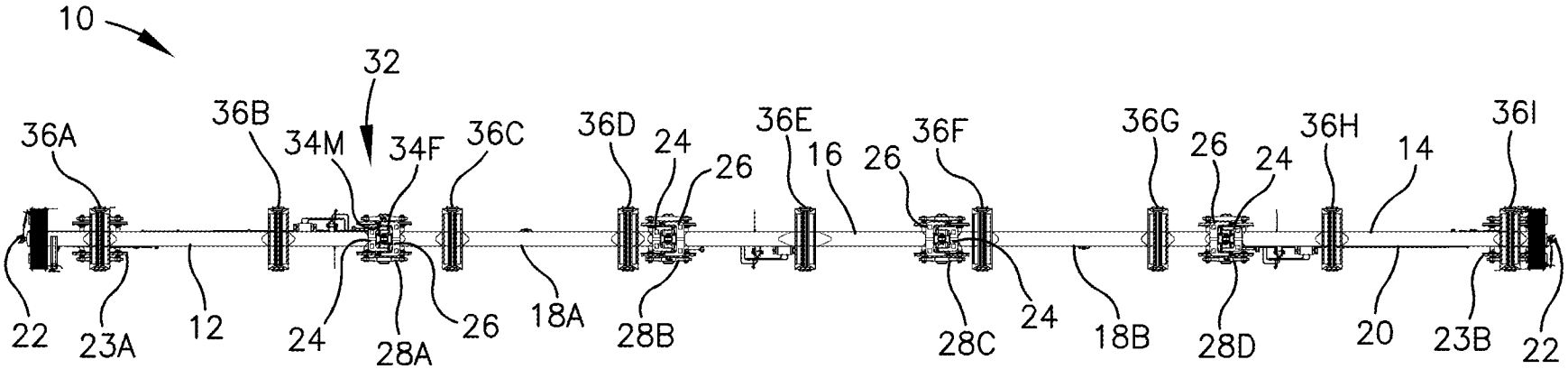
FIG. 3 is a top plan view of the car of FIG. 1.

As depicted in FIGS. 1-3, each of the segments 12, 14, 16, 18 include a body 20 formed from an I-beam- or box-beam-styled member in a manner similar to what may be referred to as a spine car or a skeleton car. The body 20 of each of the segments 12, 14, 16, 18 may be uniquely configured and/or dimensioned for each of the respective segments 12, 14, 16, 18. In another embodiment, the bodies 20 may be provided in other forms similar to that of a flat-car, box-car, gondola car, or the like. The spine car-type configuration is preferable in some embodiments due to the reduction in weight that such a configuration provides.

The bodies 20 of the leading-end and trailing-end segments 12, 14 are each provided with a coupler 22 disposed at their respective free ends, i.e. at opposite ends of the car 10. The couplers 22 comprise standard couplers employed in the rail industry for coupling cars, rolling stock, locomotives, or the like such as Janney couplers, Association of American Railroads (AAR) couplers, or the like.

The free ends of the leading-end and trailing-end segments 12, 14 are supported on dedicated trucks 23 or bogies. Opposite ends of the leading-end and trailing-end segments 12, 14 and each end of the central and intermediate segments 16, 18 are each provided with a male or a female adaptor 24, 26 configuration that is adapted to couple to and be supported on a shared truck 28 or bogie.

The dedicated and shared trucks 23, 28 may be configured similarly to a Jacobs bogie in which each of the trucks 23, 28 includes two pairs of wheels 30 mounted on longitudinally spaced apart axles. The trucks 23, 28 may include braking and suspension means among other components available in the art.

The shared trucks 28 may provide a common pivot assembly 32 to which adjacent segments 12, 14, 16, 18 are connected which allows both segments 12, 14, 16, 18 to pivot laterally relative to one another and relative to the shared truck 28 as the car 10 traverses curves in the railway. The pivot assembly 32 may also allow the adjacent segments 12, 14, 16, 18 to pivot at least partially side-to-side and fore and aft relative to the shared truck 28. The pivot assembly 32 however provides a slackless coupling, i.e. one that substantially maintains a spacing between adjacent segments 12, 14, 16, 18 such that a longitudinal distance between the segments 12, 14, 16, 18 is maintained or does not substantially change as the car 10 is placed under longitudinal compressive or tension forces, e.g. when the car 10 is pulled or pushed. The overall length of the car 10 thus remains substantially constant during operation. In contrast, known rail-transport systems employ standard couplings which can have up to six inches or more of coupler slack between each of the cars. Such slack is compounded by the large number of cars and can result in several feet of longitudinal movement of ends of the ribbon rails relative to rail stands at the ends of the rail-transport train.

Figure 3A:
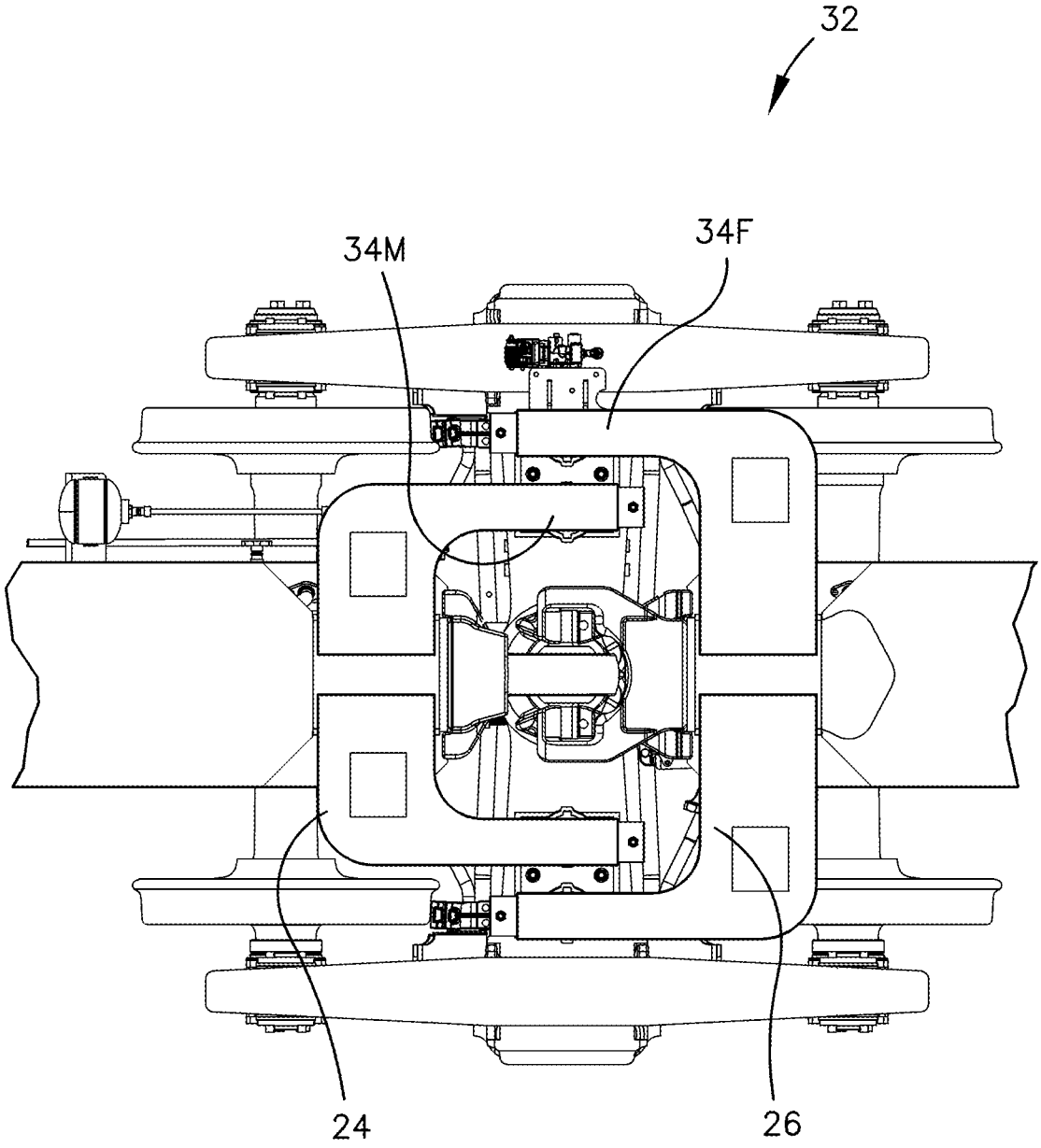
FIG. 3A is an enlarged view of a coupling between adjacent segments of the articulated rail-transport car of FIG. 1.
Figure 4:
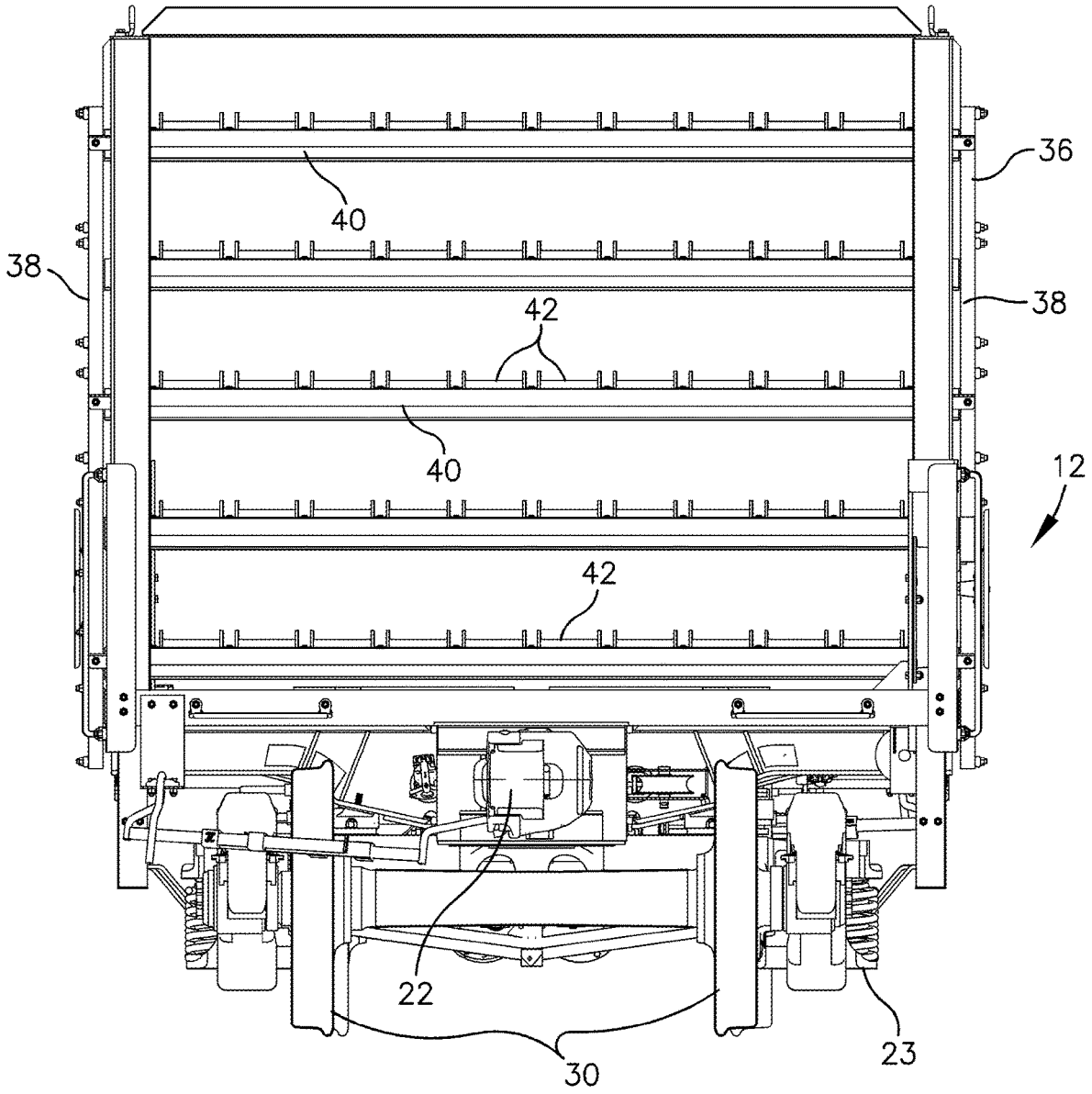
FIG. 4 is an end elevational view of a segment of the car of FIG.1 depicting a rail stand thereon in accordance with an exemplary embodiment.

As shown in FIG. 3A, the male and female adaptors 24, 26 are each provided with a forked configuration with a pair of longitudinally extending and transversely spaced apart arms 34. The arms 34*f* of the female adaptor 26 are spaced transversely apart a greater distance than the arms 34*m* of the male adaptor 24 such that when coupled to the shared truck 28, the arms 34*m* of the male adaptor 24 are at least partially disposed between the arms 34*f* of the female adaptor 26. Although a particular configuration of the male and female adaptors 24, 26 and their coupling with the shared truck 28 is shown and described herein, such is not intended to limit exemplary embodiments. Other adaptor configurations and couplings with the shared truck 28 may be employed without departing from the scope of embodiments described herein.

A plurality of rail stands 36 are disposed on the car 10 spaced longitudinally apart along the length thereof. The stands 36 may take a variety of configurations to accommodate a particular number, gage, weight, or style of ribbon rails to be carried thereon, however each of the rail stands 36 is preferably configured to support each ribbon rail disposed on the car 10. In one embodiment, depicted in FIG. 4, each stand 36 includes a pair of upright members or posts 38 spaced transversely apart with a plurality of vertically stacked shelves 40 or tiers extending therebetween. Each shelf 40 provides a number of rollers 42 rotatably mounted end-to-end across the length of the shelf 40 and configured to rotate about an axis extending parallel to the length of the shelf 40 and transversely relative to the car 10.

Each roller 42 is sized to receive a base flange or foot of a respective ribbon rail and may include flanges projecting radially outward from ends of the roller 42 to hold the respective ribbon rail in alignment with the roller 42. Each roller 42 thus forms a pocket in which the ribbon rail may be disposed. In other embodiments, more than one roller 42 may be employed to support each ribbon rail and flanges may be provided on the shelf 40 instead of or in addition to flanges on the roller 42 among a variety of other configurations. In the embodiment shown in FIG. 4, each rail stand 36 includes five shelves 40 with ten rollers 42 disposed thereon to support up to fifty ribbon rails at a time. However, it is to be understood that other numbers of shelves 40 and/or rollers 42 thereon may be employed without departing from the scope of embodiments described herein.

The longitudinal spacing between the rail stands 36 is sufficient to enable adequate flexure and bending of the ribbon rails as the car 10 navigates curves in the railway while also preventing excessive droop in a leading end of the ribbon rail as it is loaded onto the rail stands 36. Generally, the spacing between the rail stands 36 is preferably not less than about 75 feet and is preferably about 27-29 feet or around about 28 feet. Spacing greater than about 75 feet or greater than about 30 feet may allow the ribbon rail to bow outwardly and flex as the segments 12, 14, 16, 18 of the car 10 pivot relative to one another when on a curve. Spacing less than about 75 feet may overly restrict such bending or bowing which may cause the ribbon rails to leave their respective pockets, damage the rail stands 36, and/or apply unwanted forces on the car 10.

A maximum spacing between the rail stands 36 is preferably not greater than about 30 feet. As the ribbon rail is loaded onto the car 10, a leading end thereof is extended unsupported from one rail stand 36 to the next. Too great a spacing between the rail stands 36 may allow the leading end to droop or sag vertically downward too great a distance causing the ribbon rail to collide with the rail stand 36 or shelves 40 thereof or to miss a desired shelf 40 entirely rather than landing on the desired roller 42.

Figure 5:
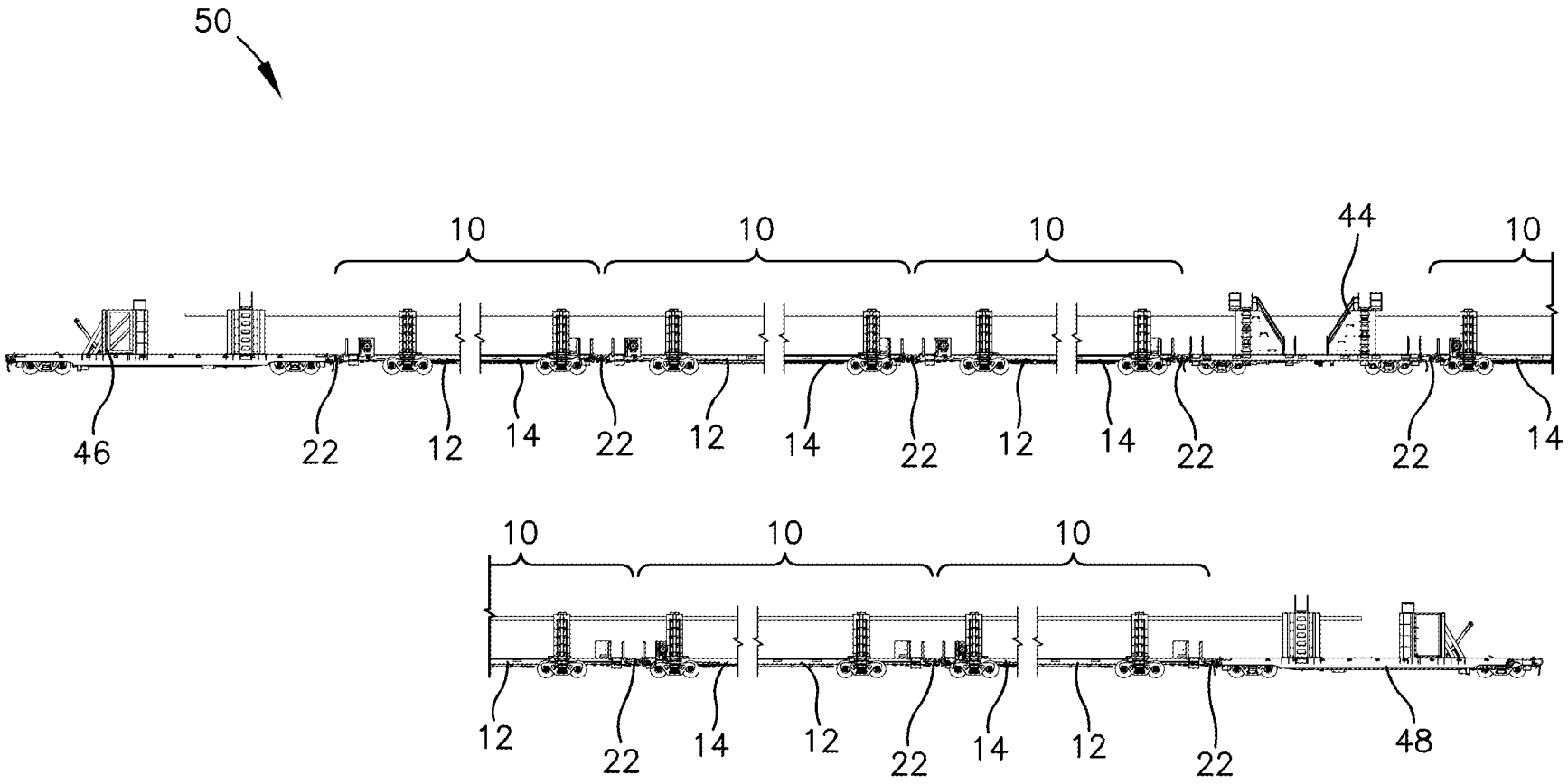
FIG. 5 is a partial side elevational view of a rail-transport train that includes a plurality of articulated rail-transport cars and a tie-down car depicted in accordance with an exemplary embodiment.

Accordingly, in a preferred embodiment, the rail stands 36 are spaced apart between about 75 feet and about 30 feet or more preferably between about 28 feet and about 30 feet. It is to be understood, that different gages and/or types of rail may have different bending properties or characteristics and that spacing between the rail stands 36 may be tailored according to such characteristics without departing from the scope of embodiments described herein. As depicted in FIG. 5, the rail stands 36 located nearest the leading end and the trailing end of the car 10 (rail stand 36A and rail stand 36I) may also be spaced apart from the respective ends of the car 10 to maintain desired minimum and maximum spacing between the rail stands 36 when the car 10 is coupled to another similarly configured car 10 or to another car, such as a tie-down car 44 or a tunnel car 46, 48, among others, that also includes rail stands 36 or other means for supporting a ribbon rail that extends between the respective cars.

With continued reference to FIGS. 1-3, each of the segments 12, 14, 16, 18 of the car 10 are provided with a unique configuration. In the embodiment shown in FIGS. 1-3, each of the segments 12, 14, 16, 18 include a different longitudinal length, and distribution of the rail stands 36 thereon. Also as described previously, adjacent ends of the segments 12, 14, 16, 18 are each provided with either a male or female configuration 24, 26. For example, the leading-end segment 12 is the longest segment, followed by the trailing-end segment 14, the intermediate segments 18, and then the central segment 16. Further, the leading-end segment 12 includes a pair of rail stands 36. The rail stand 36A nearest the leading end of the segment 12 is disposed to directly overlie the dedicated truck 23A while a second rail stand 36B is disposed along the length of the segment 12 between the dedicated truck 23A and the shared truck 28A. The trailing-end segment 14 is similarly configured with one rail stand 36I nearest the trailing end of the segment 14 overlying the dedicated truck 23B and a second rail stand 36H disposed along the length of the segment 14 between the dedicated truck 23B and the respective shared truck 28D. Both the leading-end and the trailing-end segments 12, 14 are provided with a male adaptor 24 for coupling with their respective shared trucks 28A and 28D, respectively.

Two intermediate segments 18A and 18B are depicted in the car 10 however any number of intermediate segments 18 may be employed in exemplary embodiments. The intermediate segments 18A and 18B each include two rail stands 36 that are shifted longitudinally toward one end or asymmetrically disposed along the length of the respective intermediate segments 18A and 18B between the respective shared trucks 28 (segment 18A includes rail stands 36C and 36D disposed between shared trucks 28A and 28B and segment 18B includes rail stands 36F and 36G disposed between shared trucks 28C and 28D).

The central segment 16 is generally symmetrically configured with a single rail stand 36E centered along the longitudinal length between the shared trucks 28B and 28C supporting each end thereof. Opposing ends of the central segment 16 are each provided with a female configuration 26 for coupling to the respective shared trucks 28B, 28C.

As such, the intermediate segments 18A and 18B are oppositely oriented on each side of the central section 16 so as to couple to the shared trucks 28B and 28C via their ends having the male adaptors 24. Ends of the segments 18A and 18B having the female adaptors 26 are thus provided for coupling to the shared trucks 28A and 28D along with the male adaptors 24 of the leading-end segment 12 and the trailing-end segment 14. It is to be understood, that the male and female adaptors 24, 26 of any of the segments 12, 14, 16, 18 may be reversed without departing from the scope of embodiments described herein.

The ability of the intermediate segments 18 to be disposable to either side of the central segment 16 by simply reversing the orientation of the intermediate segment 18 reduces manufacturing and maintenance complexities. Additionally, this configuration increases the adaptability of the car 10 to varied applications by enabling additional intermediate segments 18 to be easily and simply disposed between one or both of the intermediate segments 18A, 18B and the respective leading-end segment 12 or trailing-end segment 14 to increase or decrease the length of the car 10. The length of the car 10 may be further adapted or decreased by removing one or both of the intermediated segments 18 and directly coupling the central segment 18 with one or both of the leading-end segment 12 or the trailing-end segment 14 via the shared trucks 28.

The location and distribution of the rail stands 36 along the longitudinal length of the car 10 and between the couplers 22 is independent of the location of the shared and dedicated trucks 28, 23 and/or is asymmetrical relative thereto. Further, the spacing between adjacent ones of the rail stands 36 may vary but preferably remains within the desired minimum and maximum described previously. For example, spacing between the rail stands 36A and 36I at the ends of the car 10 and the respective next adjacent rail stands 36B and 36H may be about 29 feet while spacing between each of the other rail stands 36B-36H may be about 28.583 feet.

The number of rail stands 36 on the car 10 is greater than the total number of trucks (dedicated trucks 23 and shared trucks 28), i.e. the ratio of the number of rail stands 36 to the number of trucks 23, 28 is greater than 1:1. In one embodiment, a ratio of the number of rail stands 36 to the total number of trucks 23, 28 is equal to or greater than 3:2. For example as depicted in FIGS. 1-3, the car 10 includes nine rail stands 36 and six trucks 23, 28 disposed between the couplers 22 at each end of the car 10. In other embodiments, the ratio of rail stands 36 to trucks 23, 28 may be 2:1, 3:1, 4:1, 4:3, 5:1, 5:2, 5:3, 6:5, 7:2, 7:3, 7:4, 7:5, 7:6, 8:3, 8:5, 8:7, or another ratio greater than 1:1.

The distribution of the rail stands 36 relative to the shared and dedicated trucks 28, 23 may provide an uneven distribution of the weight of the ribbon rails on the trucks 28, 23. In some embodiments, the shared trucks 28 supporting the central segment 16 carry a greater weight than the dedicated trucks 23 and the shared trucks 28 supporting the leading-end segment 12 and the trailing-end segment 14. For example, the dedicated trucks 23 might carry about 124,000 pounds each when fully loaded, while the shared trucks 28A and 28D might carry about 135,000 pounds, and the shared trucks 28B and 28C might carry about 142,400 pounds.

With reference now to FIG. 5, a plurality of the articulated rail-transport cars 10 may be incorporated into a rail-transport train 50 to transport ribbon rails having a length greater than the longitudinal length each of the cars 10 individually. The rail train 50 may also include a tie-down car 44, a tunnel car 46 at the leading end thereof, and a tunnel car 48 at the trailing end thereof. As depicted in FIG. 5, the rail train 50 includes six rail-transport cars 10. The tie-down car 44 is positioned in the middle of the six rail-transport cars 10, i.e. between the third and fourth of the rail-transport cars 10. In one embodiment, the orientation of the rail-transport cars 10 is reversed on each side of the tie-down car 44 as depicted in FIG. 5, however other configurations may be employed. Each of the tunnel cars 46, 48, the rail-transport cars 10, and the tie-down car 44 are coupled together via couplers like the couplers 22 and may be coupled at either end of the train 50 to another train 50, a power unit or other propulsion means, and/or to one or more other rail-based cars.

The tie-down car 44 may employ known configurations and includes a plurality of clamping units, at least one for each ribbon rail carried by the train 50. In one embodiment, the tie-down car 44 is an automated tie-down car or includes automated clamping units that are controllable by an operator at the tie-down car 44, at an operator's station elsewhere on the rail-transport train, or remotely. The clamping units fix the ribbon rail against longitudinal movement relative to the tie-down car 44 to retain the ribbon rail in position during transport.

The tunnel cars 46, 48 may also employ known configurations and, as such, may include means for aiding loading and unloading the ribbon rails onto the train 50 and for preventing the ribbon rails from inadvertently traveling longitudinally along the train 50 if the associated clamping units fail or are damaged.

As depicted in FIG. 5, ribbon rails having a length of, for example up to 7,600 feet may be transported by the train 50. The train 50 may be otherwise configured with greater or fewer numbers of rail-transport cars 10 as needed to accommodate longer or shorter lengths of ribbon rails. To load the ribbon rail, the ribbon rail may be fed into a pocket of a first rail stand 36 on a first of the rail-transport cars 10. The ribbon rail is driven by means carried on one of the tunnel cars 46, 48 or on another loading apparatus to extend onto a next adjacent rail stand 36 and then onto each subsequent rail stand 36 on the first rail-transport car 10. The ribbon rail is further driven to extend to the rail stands 36 on each of the subsequent rail-transport cars 10 until fully loaded onto the train 50. A respective clamping unit on the tie-down car 44 is actuated to fix the ribbon rail into position.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Identification of structures as being configured to perform a particular function in this disclosure and in the claims below is intended to be inclusive of structures and arrangements or designs thereof that are within the scope of this disclosure and readily identifiable by one of skill in the art and that can perform the particular function in a similar way. Certain features and sub-combinations are of utility and may be employed without reference to other features and sub-combinations and are contemplated within the scope of the claims.

What is claimed is:

1. An articulated rail-transport car for transporting a plurality of ribbon rails along a railway, the car comprising:

a plurality of longitudinally extending segments, each of the longitudinally extending segments disposed end-to-end;

a plurality of shared trucks, each of the plurality of shared trucks having a common pivot assembly connected to and supporting adjacent respective ends of each of the longitudinally extending segments and configured to enable pivoting of the segments relative to one another;

a first dedicated truck supporting a free end of a first segment of the plurality of segments, the free end of the first segment extending longitudinally beyond the first dedicated truck and being disposed at the first end of the car;

a second dedicated truck supporting a free end of a second segment of the plurality of segments, the free end of the second segment extending longitudinally beyond the second dedicated truck and being disposed at a second end of the car, the second end being opposite from the first end; wherein the plurality of longitudinally extending segments, supported at adjacent respective ends on respective ones of the plurality of shared trucks, extend from the first dedicated truck to the second dedicated truck; and a number of rail stands configured to support a plurality of ribbon rails and disposed on the plurality of longitudinally extending segments, the rail stands being spaced apart along a longitudinal length of the rail-transport car and spaced longitudinally apart from each of the plurality of shared trucks, wherein a ratio of the number of rail stands to a total number of the shared trucks plus the first and second dedicated trucks is greater than 1:1.

2. The rail-transport car of claim 1, wherein the ratio of the number of rail stands to the total number of shared trucks plus the first and second dedicated trucks is equal to or greater than 3:2.

3. The rail-transport car of claim 1, wherein the ratio of the number of rail stands to the total number of shared trucks plus the first and second dedicated trucks is equal to or greater than 4:3.

4. The rail-transport car of claim 1, wherein the rail stands are not evenly longitudinally spaced apart.

5. The rail-transport car of claim 4, wherein adjacent ones of the rail stands disposed near a longitudinal center of the rail-transport car are spaced closer together than adjacent ones of the rail stands disposed near the first and second ends of the rail-transport car.

6. The rail-transport car of claim 1, wherein the first and second segments disposed at the first and second ends of the rail-transport car are longer than the segments disposed nearer to a longitudinal center of the rail-transport car.

7. The rail-transport car of claim 1, further comprising: a plurality of similarly configured rail-transport cars coupled to the rail-transport car to form a rail-transport train, and wherein sections of ribbon rail to be transported are disposed on the rail-transport train and extend between adjacent ones of the rail-transport cars.

8. The rail-transport car of claim 7, further comprising: a tie-down car disposed centrally within the rail-transport train between adjacent ones of the rail-transport cars and configured to secure each of the sections of ribbon rail against longitudinal movement along the rail-transport train.

9. The rail-transport car of claim 1, wherein the plurality of longitudinally extending segments includes the first segment and the second segment and a third, fourth, and fifth segment arranged in numerical order between the first and second segments, and wherein the first segment has a first longitudinal length, the third and fifth segments have a second longitudinal length that is shorter than the first longitudinal length, and the fourth segment has a third longitudinal length that is shorter than the second longitudinal length.

10. The rail-transport car of claim 9, wherein the second segment has a fourth longitudinal length that is shorter than the first longitudinal length but longer than the second longitudinal length.

11. A rail-transport consist for transporting a plurality of ribbon rails along a railway, the consist comprising:

a plurality of articulated rail-transport cars coupled end-to-end, each articulated rail-transport car including a plurality of longitudinally extending segments, each of the longitudinally extending segments pivotably coupled end-to-end to an adjacent longitudinally extending segment via a shared truck, each of the shared trucks having a common pivot assembly connected to and supporting adjacent respective ends of the adjacent longitudinally extending segments, the plurality of longitudinally extending segments including a first segment having a first free end extending beyond and supported by a first dedicated truck and including a first car coupler configured to couple to an adjacent car and a second segment having a second free end extending beyond and supported by a second dedicated truck and including a second car coupler, each articulated rail-transport car further including a plurality of rail stands asymmetrically disposed and spaced longitudinally apart along the plurality of segments and configured to support a ribbon rail disposed thereon, for each articulated rail-transport car a ratio of a number of rail stands to a total number of shared trucks plus dedicated trucks is equal to or greater than 1:1; and a tie-down car disposed centrally within the rail-transport consist between adjacent ones of the rail-transport cars and configured to secure the ribbon rail against longitudinal movement along the rail-transport consist.

12. The rail-transport consist of claim 11, wherein a spacing between each of the rail stands on each rail-transport car is independent of a spacing between each of the shared trucks and the first and second dedicated trucks.

13. The rail-transport consist of claim 11, wherein on each rail-transport car two of the plurality of rail stands form end stands, and wherein each of the end stands vertically overlies a respective one of the first and second dedicated trucks, and wherein the remaining rail stands in the plurality of rail stands are spaced longitudinally apart from each of the shared trucks.

14. The rail-transport consist of claim 11, wherein on each rail-transport car the plurality of segments includes an odd number of segments and includes a pair of end segments and a central segment, and wherein a center rail stand of the plurality of rail stands is generally longitudinally centered on the central segment, the plurality of rail stands is generally symmetrically distributed longitudinally forward and aft of the center rail stand relative to the center rail stand but is asymmetrically distributed relative to the respective segments.

15. An articulated rail-transport car for transporting a plurality of ribbon rails along a railway, the car comprising:

a first end-segment that includes a first dedicated truck supporting a first end of the first end-segment, the first end including a first coupler configured to couple to an adjacent rail car, an opposite second end of the first end-segment including a first configuration of shared-truck-adaptor;

a second end-segment that includes a second dedicated truck supporting a first end of the second end-segment, the first end including a second coupler configured to couple to an adjacent rail car, an opposite second end of the second end-segment including the first configuration of shared-truck adaptor;

a central segment that includes a second configuration of shared-truck adaptor at each end thereof;

one or more intermediate segments that include the first configuration of shared-truck adaptor at one end and the second configuration of shared-truck adaptor at the opposite end;

a plurality of shared trucks disposed beneath junctions between adjacent ones of the first end-segment, the second end-segment, the central segment, and the one or more intermediate segments, the shared trucks supporting adjacent respective ends of the segments and enabling pivoting of the segments relative to one another;

a number of rail stands configured to support a plurality of ribbon rails disposed thereon, the rail stands being spaced apart along a longitudinal length of the rail-transport car and spaced longitudinally apart from each of the shared trucks, a ratio of the number of rail stands to a total number of the shared trucks and the dedicated trucks being equal to or greater than 1:1.

16. The rail-transport car of claim 15, wherein the central segment includes a single centrally longitudinally located rail stand.

17. The rail-transport car of claim 15, wherein each of the first end-segment, the second end-segment, and the one or more intermediate segments each include two rail stands that are positioned asymmetrically along the longitudinal length of the respective first end-segment, the second-end segment, and the one or more intermediate segment.

18. The rail-transport car of claim 15, wherein locations of the number of rail stands along the longitudinal length of the rail-transport car are independent of locations of the first dedicated truck, the second dedicated truck, and the plurality of shared trucks.

19. The articulated rail-transport car as in claim 1 wherein each rail stand comprises a plurality of vertically stacked shelves extending between upright members, each shelf includes a plurality of rollers rotatably mounted across the shelf and configured to rotate about an axis extending parallel to the length of the shelf and transversely relative to the segment on which the rail stand is disposed and each roller is sized to receive a base flange of a ribbon rail and form a pocket in which the ribbon rail may be disposed.

20. The rail-transport consist as in claim 11 wherein each rail stand comprises a plurality of vertically stacked shelves extending between upright members, each shelf includes a plurality of rollers rotatably mounted across the shelf and configured to rotate about an axis extending parallel to the length of the shelf and transversely relative to the segment on which the rail stand is disposed and each roller is sized to receive a base flange of a ribbon rail and form a pocket in which the ribbon rail may be disposed.

21. The articulated rail-transport car as in claim 15 wherein each rail stand comprises a plurality of vertically stacked shelves extending between upright members, each shelf includes a plurality of rollers rotatably mounted across the shelf and configured to rotate about an axis extending parallel to the length of the shelf and transversely relative to the segment on which the rail stand is disposed and each roller is sized to receive a base flange of a ribbon rail and form a pocket in which the ribbon rail may be disposed.

22. A method for transporting a plurality of ribbon rails along a railway, the method comprising:

providing a plurality of articulated rail-transport cars positioned end-to-end on a railway, each of the rail-transport cars including a plurality of longitudinally extending segments that are pivotably coupled together end-to-end and supported on shared trucks, each of the shared trucks having a common pivot assembly connected to and supporting adjacent respective ends of longitudinally adjacent segments, first and second longitudinal ends of each rail-transport car being supported on first and second dedicated trucks respectively wherein each of the first and second dedicated trucks includes a coupler configured to couple with an adjacent rail car and wherein the plurality of longitudinally extending segments, supported at adjacent respective ends on respective ones of the plurality of shared trucks, extend from the first dedicated truck to the second dedicated truck;

providing on the plurality of longitudinally extending segments of each of the rail-transport cars a number of rail stands that are spaced apart from the shared trucks such that a ratio of the number of rail stands to a total number of shared trucks plus dedicated trucks is greater than 1:1;

providing a tie-down car disposed between adjacent ones of the rail-transport cars and including a clamping unit configured to secure a section of ribbon rail against longitudinal movement; and coupling adjacent ones of the rail-transport cars and the tie-down car together using their respective couplers at the longitudinal ends thereof to form a rail-transport train.

23. The method of claim 22 wherein each of the rail stands provided comprises a plurality of vertically stacked shelves extending between upright members, each shelf includes a plurality of rollers rotatably mounted across the shelf and configured to rotate about an axis extending parallel to the length of the shelf and transversely relative to the segment on which the rail stand is disposed and each roller is sized to receive a base flange of a ribbon rail and form a pocket in which the ribbon rail may be disposed.

24. The method of claim 22 further comprising:

assembling the plurality of articulated rail-transport cars, each of the rail-transport cars including a first end-segment including a first configuration of shared-truck-adaptor, a second end-segment that includes the first configuration of shared-truck adaptor, a central segment that includes a second configuration of shared-truck adaptor at each end thereof, and one or more intermediate segments that include the first configuration of shared-truck adaptor at a first end thereof and the second configuration of shared-truck adaptor at an opposite second end thereof, a first of the intermediate segments being included in the articulated rail-transport car in a first orientation between the first end-segment and the central segment and a second of the intermediate segments being included in a second orientation between the second end-segment and the central segment, the second orientation being reversed from the first orientation.

* * * * *